US005530230A

United States Patent [19]

Smith et al.

[11] Patent Number: 5,530,230

[45] Date of Patent: Jun. 25, 1996

[54] VARIABLE PASSWORD SAFETY INTERLOCK SYSTEM FOR MICROWAVE OVENS AND OTHER APPLIANCES

[76] Inventors: Andrew M. Smith, 8 Sunrise Dr., Armonk, N.Y. 10504; James P. Smith, 3480 Granada Ave., Apt. 245, Granada, Calif. 95051

[21] Appl. No.: 326,527

[22] Filed: Oct. 20, 1994

[51] Int. Cl.[6] ..... H05B 6/68

[52] U.S. Cl. ..... 219/723; 219/702; 219/720; 219/482; 99/325; 307/142; 380/23

[58] Field of Search ..... 219/723, 722, 219/702, 720, 715, 716, 482; 99/325, 451; 307/142; 340/540, 541, 542, 543; 380/23, 24, 25

[56] References Cited

U.S. PATENT DOCUMENTS

| | | | |
|---|---|---|---|
| 5,177,789 | 1/1993 | Covert | 380/23 |
| 5,231,310 | 7/1993 | Oh | 307/142 |
| 5,331,575 | 7/1994 | Koether et al. | 99/325 |
| 5,375,508 | 12/1994 | Knepler et al. | 219/483 |
| 5,432,851 | 7/1995 | Scheidt et al. | 380/25 |

*Primary Examiner*—Philip H. Leung

*Attorney, Agent, or Firm*—Cowan, Liebowitz & Latman

[57] ABSTRACT

A new variable password safety interlock system for microwave ovens and other computerized or electrical appliance allows the user to dynamically and automatically generate a new password immediately prior to each use. The variable password comprises some prearranged transposition or combination of numbers of digits that were already entered into the microwave control panel by the user. The user first enters digits representing the microwave time, the target food temperature, the microwave power level, the actual time of day on display or some other required combination of digits or microwave console buttons, and then presses the "Start" button. The new value of the variable password for that use of the microwave will be some prearranged transposition or combination of the digits, numbers or buttons that had just previously been pressed by the user and that appeared on the microwave control panel at the moment the user pressed the "Start" button. Preferably, the password is the digits of the microwave heating time just entered by the user but in reverse order. The password does not require memorization and is easy for the user to compute because the numbers are on display to the user. This password safety interlock is child-proof because a young child will be unable to compute the ephemeral and varying password needed to operate the microwave.

35 Claims, 3 Drawing Sheets

VARIABLE PASSWORD SAFETY INTERLOCK SYSTEM FOR MICROWAVE OVENS AND OTHER APPLIANCES

BACKGROUND OF THE INVENTION

This invention relates to the field of locking devices. More particularly, this invention relates to the field of computerized locking devices having passwords. Still more particularly, this invention relates to computerized locking devices as they pertain to use with computerized electrical devices or appliances, particularly microwave ovens.

All microwave ovens incorporate mechanical or electrical safety interlock devices that prevent microwaves from being generated whenever the door of the oven is open. These interlock devices are intended to protect people (both adults and children), animals and other objects near the microwave oven from being exposed to harmful microwave energy in the event that the oven's door is accidentally opened while the microwave oven is in operation.

Nowadays, operation of a microwave oven is so simple that even a young child can operate one. Unfortunately, no safety interlock exists that would prevent a child from microwaving a toy or other item out of curiosity or as part of a "pretend" activity. This invention is intended to provide protection against such an activity. One can imagine dangerous situations arising when children, under the age of about seven, the age at which abstract reasoning capabilities begin to emerge, cause a microwave oven to operate without knowing which objects are microwave safe. These dangerous situations can occur when a child operates any electrical appliance. In the case of microwave ovens, manufacturers have left children, and households with children, only one button away from a catastrophe.

Typical of the dangerous scenarios that this invention is intended to prevent is a situation in which a young girl wakes up early on a cold winter morning and finds that her doll has fallen on the floor during the night. When she retrieves it, it is very cold. She has an association that, when something is cold, like milk, and one wants it to be warm, one puts it into the microwave oven and presses the buttons. The young girl then places the doll in the microwave oven and mimics the button-pressing motions that she has seen her parents perform many times before. When the oven starts operating, the plastic materials of the doll may melt and begin to burn, and any metallic parts may give off sparks and set fire to the doll's clothing. The child may be near enough to inhale toxic fumes or may be burned or have her pajamas set on fire.

Among the existing forms of safety interlock that would have prevented such a scenario are the physical lock and key method and the preset password method. The lock and key method has been used quite effectively in many fields as a way of preventing unauthorized persons, i.e., those who do not physically possess a copy of the key, from gaining access to the device that is locked. Similarly, the use of "passwords," including numerical sequences, as a safety or security device has been a common part of society ever since the original "Open Sesame." Most mechanized or computerized embodiments, ranging from numerically operated door locks to automatic teller machines, use preset passwords. In addition, all existing password embodiments keep the password hidden from casual view. These typical approaches are thought to be effective because a child would need to physically unlock a microwave oven using a key or would need to press a particular preset sequence of buttons in order to operate the microwave oven.

However, neither of the above approaches is suitable for use in controlling access by children to a microwave oven. The lock and key method has proven to be much too inconvenient to assure continued safety because the physical key is likely to be lost or permanently inserted into the lock, and thus rendered unusable to others. Also, the child may fiend the key and may even be able to open the lock, thus thwarting the safety interlock feature. Similarly, the preset password approach also proves to be inconvenient because it requires the adult to set and then remember the password; should the password be forgotten, however, the user will be unable to operate the microwave oven until a new password is set. Also, the password may inadvertently be divulged to children, as when friends and neighbors drop in and use the microwave oven, and the password is called out loud to them ("Oh yeah. Hit one, two, three, start!"). And, because children learn their numbers at a very young age, children hearing this sequence of numbers will easily learn the password. For these reasons, neither of these approaches is satisfactory.

It is, therefore, one object of this invention to provide a child-proof safety interlock system for a microwave oven.

It is also an object of this invention to provide a safety interlock system for a microwave oven using a variable password.

It is a further object of this invention to provide a safety interlock system for a microwave oven using a variable password that is dynamically generated by the user just prior to each use.

It is still a further object of this invention to provide a safety interlock system for a microwave oven using a variable password that is always in plain view to the user so that the user does not have to remember it.

It is yet another object of this invention to provide a child-proof safety interlock system for any electrical device or appliance that can be dangerous when used by children.

These and other objects of the invention will become more apparent from the discussion below.

SUMMARY OF THE INVENTION

The above and other objects of the invention are accomplished by providing a new variable password safety interlock system for microwave ovens and other computerized or electrical appliances, which system allows the user to dynamically and automatically generate a new password immediately prior to each use. The variable password comprises some prearranged transposition or combination of numbers of digits that were already entered into the microwave or appliance control panel by the user. When this interlock system is used with microwave ovens, the user first enters digits representing the microwave time, the target food temperature, the microwave power level, the actual time of day on display or some other required combination of digits or microwave console buttons, and then presses the "Start" button. The new value of the variable password for that use of the microwave will be some prearranged transposition or combination of the digits, numbers or buttons that had just previously been pressed by the user and that appeared on the microwave control panel at the moment the user pressed the "Start" button. Preferably, the password is the digits of the microwave time just entered by the user but in reverse order. This variable password safety interlock system can also be used with other appliances. The password does not require memorization and is easy for the user to compute because the numbers are on display to the user. The variable password safety interlock is intended to prevent young children from accidentally or intentionally causing a microwave oven or other dangerous appliance to operate. This password safety interlock is child-proof because a young child will be unable to compute the ephemeral and varying password needed to operate the microwave.

DETAILED DESCRIPTION OF THE DRAWINGS

The above and other objects and advantages of the invention will become apparent upon consideration of the following detailed description, in which the reference characters refer to like parts throughout and in which.

DETAILED DESCRIPTION OF THE INVENTION

Figure 1:
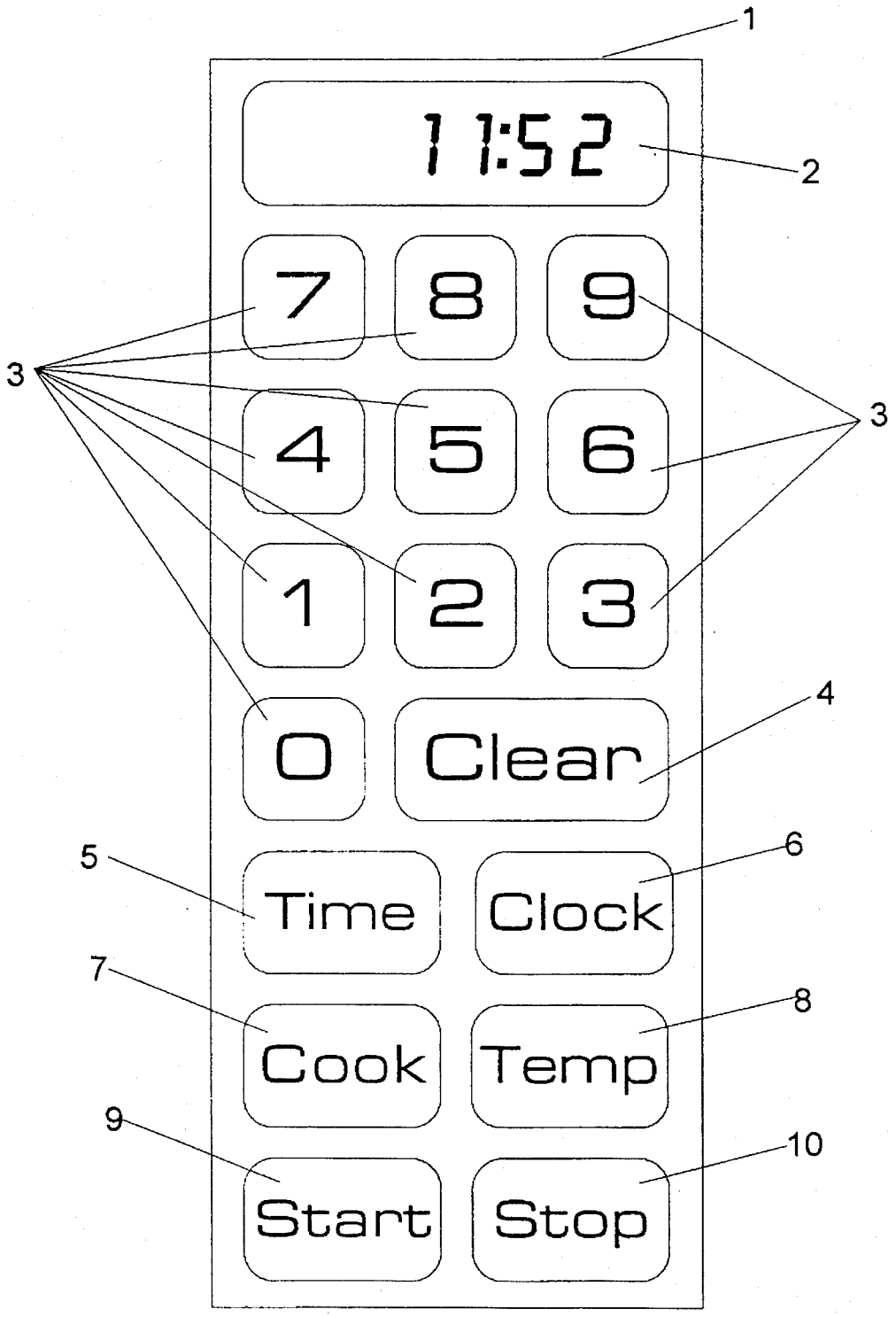
FIG. 1 shows a typical control panel for a computerized microwave oven.

FIG. 1 represents a typical control panel 1 for a computerized microwave oven. A typical control panel 1 should preferably have the following components:

(1) a numeric display 2 for displaying the time of day when the oven is not is use and for displaying the cooking time, the cooking temperature or other variables when entered by a user;

(2) numeric digit keys 3 for use by the user when entering the correct time of day or the desired cooking time or temperature;

(3) time key 5 for enabling the user to enter the desired cooking time on the display 2;

(4) clock key 6 for enabling the user to enter the correct time of day on the display 2;

(5) cook key 7 and temperature key 8 for enabling the user to enter the desired cooking power level and cooking temperature, respectively, on the display 2; and (6) start key 9 and stop key 10 for starting and stopping the operation of the microwave oven, respectively.

Figure 2:
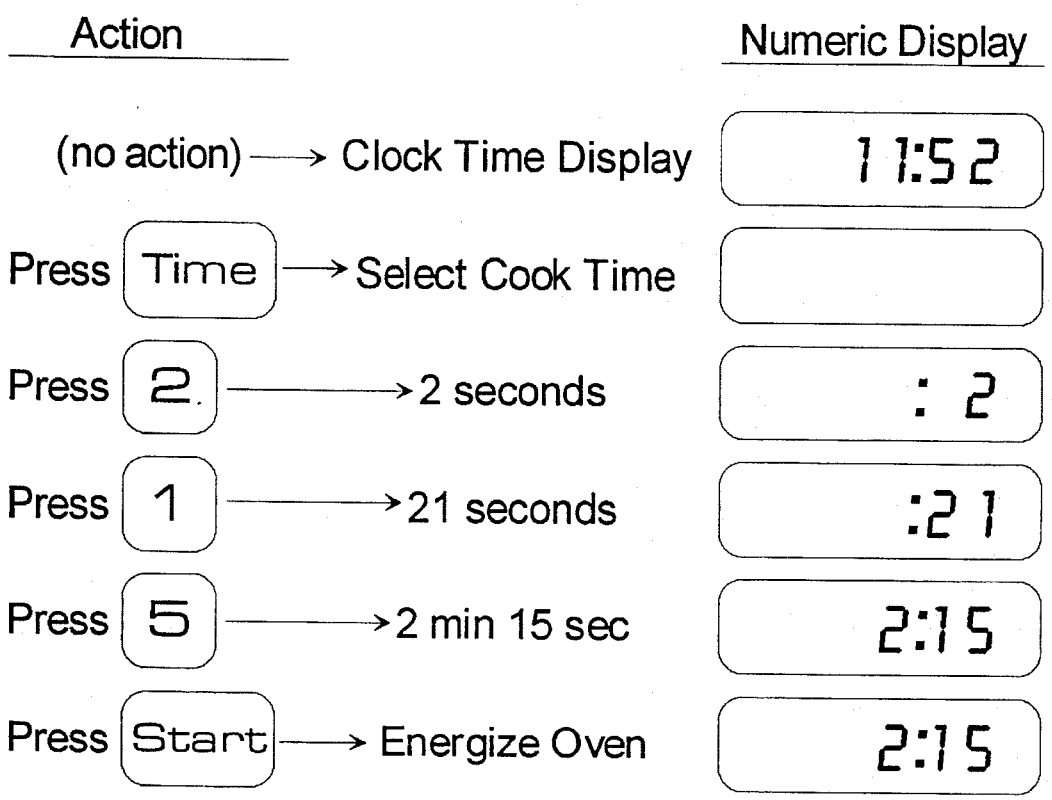
FIG. 2 shows a typical sequence of control panel operations for operating a typical microwave oven.

The typical operating sequence for a user using this control panel in order to microwave an item for a particular amount of time is first to press the "Time" key 5 and then to press the digits 3 representing the time, in minutes and seconds, for which the item is to be microwaved. Thus, for example, as shown in FIG. 2, in order to operate the microwave oven for two minutes and fifteen seconds, the operator would first press the "Time" key 5, next press the "2", "1" and "5" digit keys 3, and finally press the "Start" key 9. This results in displaying the selected time "2:15" on the numeric display 2 and starting the oven.

An essential feature of this invention, however, is that the microwave oven does not start to operate immediately when the "Start" key 9 is pressed, but rather only after the variable password, followed again by the "Start" key 9, is entered afterward. In this invention, the variable password is determined by the digits on the numeric display 2 of the control panel 1 at the moment that the "Start" key 9 is first pressed. The variable password can be any sequence of numbers depending on the digits entered by the user and, therefore, changes with each use of the microwave oven. Thus, each time that the oven is used, the normal sequence of operations automatically provides a new, current password. To actually begin the microwave heating, the user must enter that new password followed by another press of the "Start" key 9.

Figure 3:
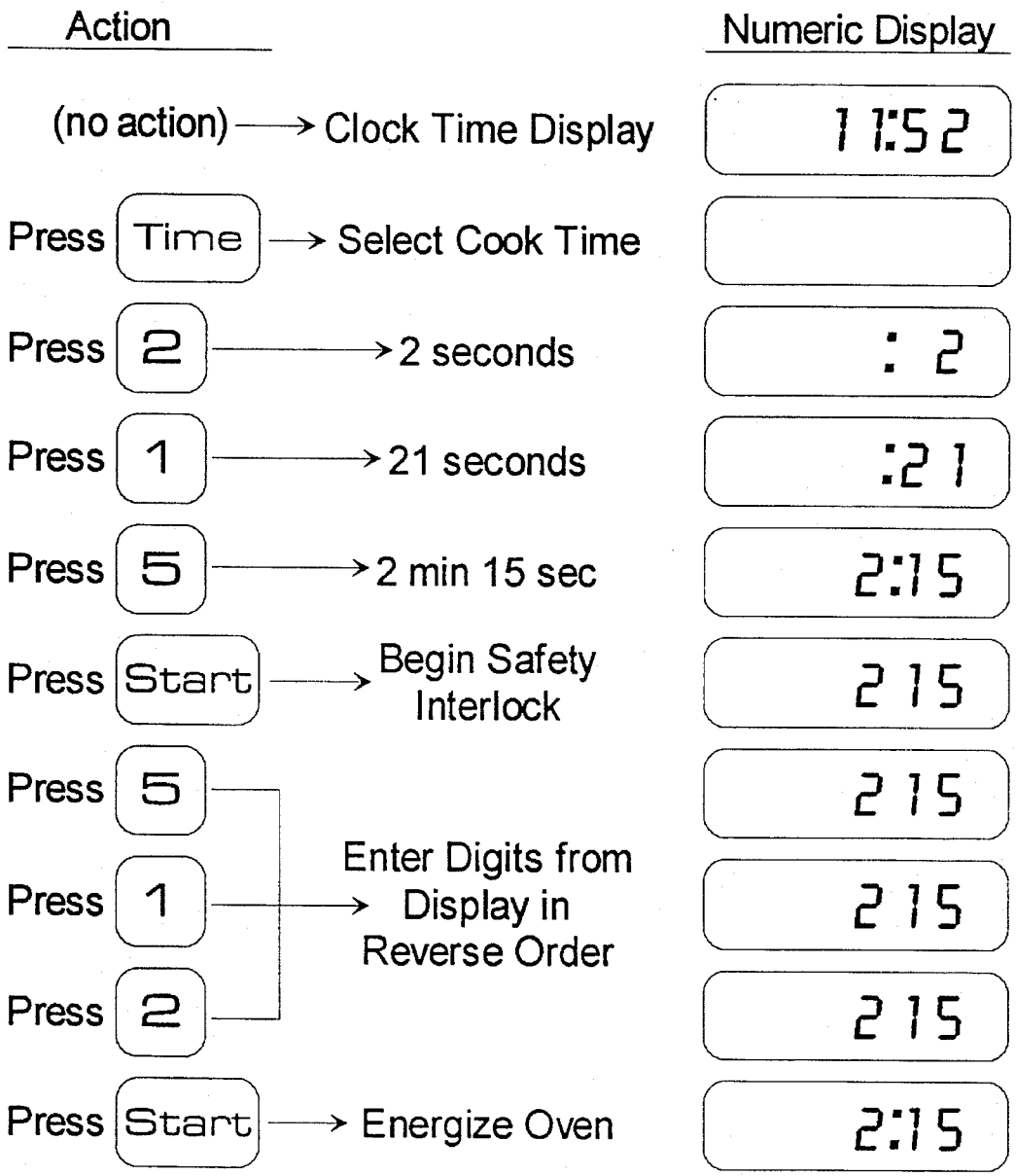
FIG. 3 shows a sequence of control panel operations required to operate a microwave oven equipped with the variable password safety interlock of a preferred embodiment of the present invention within its control program.

In a preferred embodiment, the password is any particular prearranged transposition of the digits of the microwave time just entered by the user. In a most preferred embodiment, the password is the reverse order sequence of the digits of the microwave cooking time entered by the user and appearing on the numeric display immediately previous to pressing the "Start" key 9. Using this embodiment with the above example, as shown in FIG. 3, the password entry sequence that would be required would be "5-1-2." In a further embodiment, regardless of whether the numeric value of the display represents cooking time, target food temperature, microwave power level or actual time of day, the numbers visible on the display when the "Start" key 9 is pressed become the digits used to compute the password for that particular use of the oven.

The password in any of these embodiments cannot easily be forgotten and is exceptionally easy for an adult who knows the "secret" to compute, because the values or digits to be entered as the password are openly displayed for reference on the microwave control panel, and the user need only transpose them according to the preset transposition. Moreover, the variable password requires no memorization by the user because a new password is dynamically and automatically generated by the microwave just prior to each use based upon the digits that were just previously entered by the user and that still appear on the microwave control panel. The variable password is also safe from discovery by children because young children, as a physiological consequence of their age, will be unable to discover or understand an abstract concept such as "the value of the display taken in reverse order." They are limited to associative reasoning, such as: "microwave oven equals makes something warm equals open and close the door equals poke numbers." Their actions mimic the behavior of their parents, from whom they learn, by repetition, the opening and closing of the door and the pressing of the buttons. By merely mimicking the actions of their parents, young children normally have about a 1-in-50 chance of successfully starting a conventional microwave oven without the variable password safety interlock of this invention. By incorporating the variable password safety interlock of this invention into the control of the microwave oven, those odds are reduced to 1-in-250,000. Looked at another way, this invention would prevent approximately 4,999 out of every 5,000 potentially dangerous incidents.

In another embodiment of this invention, the variable password safety interlock system can be used to ensure the safety of children from almost any household electrical device or appliance. Moreover, this interlock system can even be used in a computerized door lock. The activation switch of the device or appliance would need to be connected to a control panel, as discussed above, having at least a display for numbers, letters or both, having number or letter (or both) digit keys, and having a "start" or "on" key. In order to activate the device, the user would first enter a random sequence of (a minimum amount of) numbers or digits of his choosing using the digit keys, which sequence would appear on the display, and next press the "start" key. The user would then enter, using the digit keys, the preset transposition (preferably, the preset transposition is the reverse order sequence) of the digits appearing on the display and again press the "start" key in order to activate the device. In this way, in order to gain access to the device or doorway, the user will choose a new, random set of digits that will then be rearranged into a new password for that use. As discussed, the password for each use is generated anew by the device just prior to that use based upon the digits just previously entered by the user and still appearing on the display of the control panel.

As set forth below, the algorithm for the interlock system of this invention is designed to be easily incorporated into the control firmware (built-in software) of microwave ovens that are currently being commercially manufactured. The interlock algorithm requires no customization for individual brands or models of microwave oven, because the algorithm receives all the necessary information about the oven in the form of input parameters to its main subroutine (or "function"). These input parameters are:

(1) Key Code for the "Start" Key: the internal key code value associated with pressing the "Start" key on the control panel;

(2) Number of Digits Visible on Display: this value indicates the number of numeric digits that are visible in the control panel's numeric display area at the moment the interlock algorithm is executed (in the example used above, using the digits "2", "1" and "5" this parameter would have a value of "3");

(3) Pointer to the Displayed Digits: this value points to a memory location at which the key codes for each of the numeric digits visible on the display are stored, in normal, left-to-right order (in the example used above, this value would refer to the first of three consecutive memory locations that contain the key codes for the "2", "1" and "5" keys); and (4) Pointer to the Get-Next-Key-Press Subroutine: this value points to a subroutine that already exists in the microwave oven's firmware and that is used to monitor the control panel and to return a unique internal code for each key that is pressed. Providing a pointer to this function of the algorithm allows the algorithm to access the internal codes for the password digit key presses, without requiring the algorithm to have any prior knowledge of the existing keyboard layout or key-panel-to-microcomputer interface.

Because it is highly likely that all of the above parameters are already present within existing microwave oven firmware, the integration of the invention within such firmware would consist of adding only a single line of programming code to that firmware. This line of code would conform to the Application Programming Interface presented below.

When completed, the algorithm returns one of two indicator values to the original firmware. One value indicates that the password sequence has been correctly entered and that the microwave generator may be energized. The other value indicates that the operator of the oven has failed to enter the password sequence correctly and that the entire oven control sequence should be canceled.

The operation of the variable password safety interlock algorithm proceeds as follows. First, the algorithm checks the number of digits visible on the display be sure that there are at least two digits. If not, the algorithm returns the "cancel" indicator. The algorithm for the password interlock system of this invention, in a preferred embodiment, requires as a matter of safety that at least two digits be visible on the display and be used in creation of the new password value. Having only one digit visible on the display and used as the variable password would set the odds of accidental operation by a child at 1-in-1000, up from 1-in-50 without the use of a password. However, requiring that two digits be visible on the display and that those two digits be used to create the new password value raises the odds of accidental operation by a child to 1-in-250,000. This requirement does not limit the practical use of the oven, since no useful microwave oven operation would result from operation of the microwave oven with an entry of only one digit, with the highest digit being nine, e.g., heating for at most nine (9) seconds, heating to a temperature of at most nine (9) degrees or heating at a power level of at most nine percent (9%).

Then, as long as the number of keys pressed at any point is less than the number of digits visible on the display, the algorithm repeatedly fetches additional key-presses and compares their codes with the codes of the digits showing on the display, in reverse order. If any key-press fails to match the expected numeric digit, then the algorithm returns the "cancel" indicator. After the keys for all of the displayed digits have been pressed in the correct (reversed) order, the algorithm monitors the control panel for one additional key-press, which must be the code for the "Start" key. If that next key-press is not the "Start" key, the algorithm returns the "cancel" indicator. If all of the requirements of the password entry have been satisfied in the correct sequence, then the algorithm returns the "OK to start the oven" indicator.

The following two programs represent the invention as reduced to practice in the "C" programming language.

Application Programming Interface:

```
/************************************ ****************************************/
/*                                                                          */
/* MWLOCK.H : Application Programming Interface (API) to Appliance Safety   */
/*            Interlock Algorithm                                           */
*/                                                                          */
/************************************ ****************************************/

/************************************ ****************************************/
/* Data type definitions                                                    */
/************************************ ****************************************/

#define UC   unsigned char          /* unsigned 8-bit integer               */
```

-continued

```
/*************************************************************************/

/* typedef for function that gets the next key code from the keypad      */

/*************************************************************************/

typedef UC KEYFUNC(void);                    /* returns next key code     */

/*************************************************************************/

/* Return code values for MwLock function                                */

/*************************************************************************/

#define MW_OK_TO_START        1

#define MW_CANCEL             2

/*************************************************************************/

/* MwLock : Main interlock function to be called from appliance's        */
/*          keyboard entry code.                                         */
/*                                                                       */
/*          Returns: MW_OK_TO_START if interlock code was entered OK.    */
/*                   MW_CANCEL      if any error during code entry.      */
/*************************************************************************/

UC MwLock(
          UC          startkey,  /* key code for START key               */
          UC          dsplen,    /* number of visible digits on display  */
          UC        * dspchar,   /* pointer to displayed key codes       */
          KEYFUNC   * keyget     /* pointer to "get key" function        */
         );
```

C-Language Implementation:

```
/*************************************************************************/

/*                                                                       */

/* MWLOCK.C : Implementation of appliance safety interlock algorithm     */

/*                                                                       */

/*************************************************************************/

/* include the API header for this module                                */

/*                                                                       */

#include "mwlock.h"

/*************************************************************************/

/* MwLock : main interlock function                                      */

/*************************************************************************/

UC MwLock(UC startkey, UC dsplen, UC * dspchar, KEYFUNC * keyget)

  UC retcode;              /* return code                               */

  UC keyctr;               /* count of keys pressed                     */

  UC keyval;               /* value of the next key code                */

  if (dsplen < 2)

    return(MW_CANCEL);          /* display must show at least 2 characters */

  keyctr = 0;                   /* initiazlize count of keys pressed     */
```

-continued

```
/* repeat the following as long as the number of characters entered          */
/* is less than the number of characters on the display                      */
/*                                                                           */
while (keyctr < dsplen)
    /* get the next key code from the appliance keyboard                     */
    /*                                                                       */
    keyval = (*keyget)( );          /* use the appliance's get key function */

    /* tally one character received                                          */
    /*                                                                       */
    keyctr = keyctr + 1;
    /* see if this matches the displayed characters (in reverse order)       */
    /*                                                                       */
    if (keyval != dspchar[dsplen - keyctr])
        return(MW_CANCEL);          /* no match, so return cancel code      */

/* all characters matched, so get one more key code                          */
/*                                                                           */
keyval = (*keyget)( );
/* see if this is the code for the START key                                 */
/*                                                                           */
if (keyval != startkey)
    return(MW_CANCEL);              /* no match, so return cancel code      */

/* correct code followed by START. return "ok to start" code                 */
/*                                                                           */
return(MW_OK_TO_START);
```

Thus, a variable password safety interlock system for microwave ovens is provided. One skilled in the art will appreciate that the claimed invention can be practiced by other than the described embodiments, which are presented for purposes of illustration and not limitation, and the present invention is limited only by the claims that follow.

What is claimed is:

1. In a method for operating a microwave oven having processing means and having a control panel with a numeric display means, digit keys and a start key, the improvement comprising a variable password safety interlock procedure comprising the steps of:

pressing by a user of digit keys for digits representing a control instruction for heating an object in said microwave oven;

displaying on said numeric display means said digits representing said control instruction for heating said object in said microwave oven as entered by said user;

pressing by said user of said start key for a first time;

composing a variable password value by said processing means using only said digits representing said control instruction as entered by said user or said digits displayed on said numeric display means;

entering by said user of a usage password value using only the digit keys for said digits displayed on said numeric display means;

pressing by said user of said start key for a second time; and verifying by said processing means that said usage password value entered by said user is identical to said variable password value composed by said processing means;

whereby said processing means enables said microwave oven to operate if said usage password value entered by said user is identical to said variable password value composed by said processing means, and said processing means disables said microwave oven from operating if said usage password value entered by said user is not identical to said variable password value composed by said processing means.

2. The method of claim 1 wherein said step of composing a variable password value by said processing means further comprises the step of rearranging in a predetermined manner the sequence of said digits representing said control instruction as entered by said user or the sequence of said digits displayed on said numeric display means.

3. The method of claim 2 wherein said step of rearranging in a predetermined manner the sequence of said digits comprises the step of transposing in reverse order said digits representing said control instruction as entered by said user or said digits displayed on said numeric display means.

4. The method of claim 1 wherein:

said microwave oven control panel further comprises a numeric display means displaying digits representing the current time of day; and said wherein said step of composing a variable password value by said processing means further comprises the step of rearranging in a predetermined manner the sequence of said digits representing said current time of day as displayed on said numeric display means.

5. The method of claim 4 wherein said step of rearranging in a predetermined manner the sequence of said digits comprises the step of transposing in reverse order said digits representing said current time of day as displayed on said numeric display means.

6. The method of claim 1 wherein:

said microwave oven control panel further comprises a heat time key; and said step of pressing by a user of digit keys for digits representing a control instruction comprises pressing by a user first of the heat time key and then of digit keys for digits representing the duration of time desired by said user for heating an object in said microwave oven.

7. The method of claim 6 wherein said step of composing a variable password value by said processing means further comprises the step of rearranging in a predetermined manner the sequence of said digits representing said duration of time as entered by said user.

8. The method of claim 7 wherein said step of rearranging in a predetermined manner the sequence of said digits comprises the step of transposing in reverse order said digits representing said duration of time as entered by said user.

9. The method of claim 1 wherein:

said microwave oven control panel further comprises a temperature key; and said step of pressing by a user of digit keys for digits representing a control instruction comprises pressing by a user first of the temperature key and then of digit keys for digits representing the temperature desired by said user for heating an object in said microwave oven.

10. The method of claim 9 wherein said step of composing a variable password value by said processing means further comprises the step of rearranging in a predetermined manner the sequence of said digits representing said temperature as entered by said user.

11. The method of claim 10 wherein said step of rearranging in a predetermined manner the sequence of said digits comprises the step of transposing in reverse order said digits representing said temperature as entered by said user.

12. The method of claim 1 wherein:

said microwave oven control panel further comprises a power level key; and said step of pressing by a user of digit keys for digits representing a control instruction comprises pressing by a user first of the power level key and then of digit keys for digits representing the power level desired by said user for heating an object in said microwave oven.

13. The method of claim 12 wherein said step of composing a variable password value by said processing means further comprises the step of rearranging in a predetermined manner the sequence of said digits representing said power level as entered by said user.

14. The method of claim 13 wherein said step of rearranging in a predetermined manner the sequence of said digits comprises the step of transposing in reverse order said digits representing said power level as entered by said user.

15. The method of claim 1 wherein said step of verifying by said processing means comprises the steps of:

checking that at least two digits are displayed on said numeric display means representing said control instruction as entered by said user;

checking that the number of digits in said usage password value entered by said user using said digit keys equals the number of digits displayed on said numeric display means representing said control instruction; and comparing the digits of said usage password value entered by said user with the digits of said variable password value composed by said processing means;

sending a microwave oven enablement indicator if said usage password value is identical to said variable password value; and sending a microwave oven disablement indicator if said usage password value is not identical to said variable password value.

16. The method of claim 15 wherein:

said step of composing a variable password value by said processing means further comprises the step of transposing in reverse order the sequence of said digits representing said control instruction as entered by said user or the sequence of said digits displayed on said numeric display means; and said step of comparing said usage password value entered by said user with said variable password value composed by said processing means further comprises the step of comparing the sequence of digits of said usage password value entered by said user with the reverse order sequence of said digits representing said control instruction as entered by said user or with the reverse order sequence of said digits displayed on said numeric display means.

17. The method of claim 1 wherein said step of composing a variable password value by said processing means comprises composing a variable password value that may be different for each use of said microwave oven.

18. In a method for operating a device having processing means and having a control panel with a numeric display means, digit keys and a start or enter key, the improvement comprising a variable password safety interlock procedure comprising the steps of:

pressing by a user of digit keys for digits of a first sequence for operating said device;

displaying on said numeric display means said digits of said first sequence for operating said device;

pressing by said user of said start or enter key for a first time;

composing a variable password value by said processing means using only said digits of said first password sequence as entered by said user or said digits displayed on said numeric display means;

entering by said user of a password sequence using only the digit keys for said digits displayed on said numeric display means;

pressing by said user of said start or enter key for a second time; and verifying by said processing means that said password sequence entered by said user is identical to said variable password value composed by said processing means;

whereby said processing means enables said device to operate if said password sequence entered by said user is identical to said variable password value composed by said processing means, and said processing means disables said device from operating if said password sequence entered by said user is not identical to said variable password value composed by said processing means.

19. The method of claim 18 wherein said step of composing a variable password value by said processing means further comprises the step of rearranging in a predetermined manner the sequence of said digits of said first sequence as entered by said user or the sequence of said digits displayed on said numeric display means.

20. The method of claim 19 wherein said step of rearranging in a predetermined manner the sequence of said digits comprises the step of transposing in reverse order said digits of said first sequence as entered by said user or said digits displayed on said numeric display means.

21. The method of claim 18 wherein said step of verifying by said processing means comprises the steps of:

checking that at least two digits are displayed on said numeric display means;

checking that the number of digits in said password sequence entered by said user using said digit keys equals the number of digits displayed on said numeric display means; and comparing the digits of said password sequence entered by said user with the digits of said variable password value composed by said processing means;

sending a device enablement indicator if said password sequence is identical to said variable password value; and sending a device disablement indicator if said password sequence is not identical to said variable password value.

22. The method of claim 21 wherein:

said step of composing a variable password value by said processing means further comprises the step of transposing in reverse order the sequence of said digits of said first sequence as entered by said user or the sequence of said digits displayed on said numeric display means; and said step of comparing said password sequence entered by said user with said variable password value composed by said processing means further comprises the step of comparing the sequence of digits of said password sequence entered by said user with the reverse order sequence of said digits of said first sequence as entered by said user or with the reverse order sequence of said digits displayed on said numeric display means.

23. The method of claim 18 wherein said step of composing a variable password value by said processing means comprises composing a variable password value that may be different for each use of said device.

24. A variable password safety interlock apparatus for an operatable host device, comprising:

digit keys for entering by a user of the digits of a first sequence for operating said device;

numeric display means for displaying said digits of said first sequence for operating said device;

a start or enter key for pressing by said user for a first time after entering said first sequence; and processing means operatably coupled to said device for composing a variable password value using only said digits of said first sequence as entered by said user or said digits displayed on said numeric display means;

whereby said user enters a password sequence using only the digit keys for said digits displayed on said numeric display means and presses said start or enter key for a second time;

whereby said processing means verifies that said password sequence entered by said user is identical to said variable password value composed by said processing means; and whereby said processing means enables said device to operate if said password sequence entered by said user is identical to said variable password value composed by said processing means, and said processing means disables said device from operating if said password sequence entered by said user is not identical to said variable password value composed by said processing means.

25. The apparatus of claim 24 wherein:

said device comprises an electrical appliance; and said first sequence for operating said device entered by said user comprises a device control instruction.

26. The apparatus of claim 24 wherein:

said device comprises a microwave oven; and said first sequence for operating said device entered by said user comprises a device control instruction for heating an object in said microwave oven.

27. The apparatus of claim 26 further comprising a heat time key;

wherein said device control instruction for heating an object in said microwave oven comprises the heat time key and digit keys for digits representing the duration of time desired by said user for heating an object in said microwave oven.

28. The apparatus of claim 27 wherein said processing means for composing a variable password value rearranges in a predetermined manner the sequence of said digits representing said duration of time as entered by said user.

29. The apparatus of claim 28 wherein said processing means for composing a variable password value transposes in reverse order said digits representing said duration of time as entered by said user.

30. The apparatus of claim 26 further comprising a temperature key;

wherein said device control instruction for heating an object in said microwave oven comprises the temperature key and digit keys for digits representing the temperature desired by said user for heating an object in said microwave oven.

31. The apparatus of claim 30 wherein said processing means for composing a variable password value rearranges in a predetermined manner the sequence of said digits representing said temperature as entered by said user.

32. The apparatus of claim 31 wherein said processing means for composing a variable password value transposes in reverse order said digits representing said temperature as entered by said user.

33. The apparatus of claim 26 further comprising a power level key;

wherein said device control instruction for heating an object in said microwave oven comprises the power level key and digit keys for digits representing the power level desired by said user for heating an object in said microwave oven.

34. The apparatus of claim 33 wherein said processing means for composing a variable password value rearranges in a predetermined manner the sequence of said digits representing said power level as entered by said user.

35. The apparatus of claim 34 wherein said processing means for composing a variable password value transposes in reverse order said digits representing said power level as entered by said user.

* * * * *